US011304527B1

(12) United States Patent
Stravitz

(10) Patent No.: US 11,304,527 B1
(45) Date of Patent: Apr. 19, 2022

(54) DRAWER RETENTION MECHANISMS FOR FURNITURE

(71) Applicant: Dooli Products, LLC, New York, NY (US)

(72) Inventor: David M. Stravitz, New York, NY (US)

(73) Assignee: Dooli Products, LLC, New York, NY (US)

( * ) Notice: Subject to any disclaimer, the term of this patent is extended or adjusted under 35 U.S.C. 154(b) by 0 days.

(21) Appl. No.: 17/581,146

(22) Filed: Jan. 21, 2022

Related U.S. Application Data

(60) Continuation-in-part of application No. 17/483,903, filed on Sep. 24, 2021, now Pat. No. 11,266,243, which is a continuation-in-part of application No. 17/443,615, filed on Jul. 27, 2021, now Pat. No. 11,234,520, which is a division of application No. 17/194,401, filed on Mar. 8, 2021, now Pat. No. 11,103,067, which is a continuation-in-part of application No. 17/094,979, filed on Nov. 11, 2020, now Pat. No. 10,939,761, which is a continuation-in-part of application No. 16/992,397, filed on Aug. 13, 2020, now Pat. No. 10,905,241, which is a continuation of application No. 16/986,932, filed on Aug. 6, 2020, now Pat. No. 10,813,456, which is a continuation-in-part of application No. 16/799,909, filed on Feb. 25, 2020, now Pat. No. 10,758,046, and a continuation-in-part of application No. 16/799,941, filed on Feb. 25, 2020, now Pat. No. 10,786,080.

(60) Provisional application No. 62/949,664, filed on Dec. 18, 2019, provisional application No. 62/944,425, filed on Dec. 6, 2019.

(51) Int. Cl.
*A47B 88/00* (2017.01)
*A47B 97/00* (2006.01)
*A47B 91/12* (2006.01)

(52) U.S. Cl.
CPC ..... *A47B 97/00* (2013.01); *A47B 91/12* (2013.01); *A47B 2097/008* (2013.01)

(58) Field of Classification Search
CPC .... A47B 97/00; A47B 91/12; A47B 2097/008
USPC ..... 312/330.1, 333
See application file for complete search history.

(56) References Cited

U.S. PATENT DOCUMENTS 4,370,007 A * 1/1983 Fler ..... A47B 88/493 312/333
4,458,964 A * 7/1984 Hardy ..... A47B 88/402 384/19

(Continued)

*Primary Examiner* — Todd M Epps
(74) *Attorney, Agent, or Firm* — Brian Roffe

(57) ABSTRACT

Dresser includes a frame having a front, a drawer slidable into and out of the frame, and a drawer retention mechanism between each side wall of the drawer and the frame alongside the side wall. The retention mechanism includes a track on the side wall defined between upper and lower parts, and a rail on the drawer movable in the track. A first stop is on the upper part and a second stop is on the drawer. The first and second stops are positioned to cause contact of a front surface of the second stop and rear surface of the first stop to prevent sliding of the drawer out of the frame and such that an angled rear surface of the second stop comes into contact with and slides over an angled front surface of the first stop during insertion of the drawer.

20 Claims, 10 Drawing Sheets

(56) References Cited

U.S. PATENT DOCUMENTS

| | | | | |
|---|---|---|---|---|
| 6,250,730 | B1 | 6/2001 | Roth et al. | |
| 6,478,393 | B2 * | 11/2002 | Kim | A47B 88/493 384/19 |
| 6,682,158 | B2 | 1/2004 | Lai | |
| 6,997,527 | B2 | 2/2006 | Cheng | |
| 7,040,725 | B1 | 5/2006 | Mao-Chin | |
| 7,232,195 | B2 * | 6/2007 | Yang | A47B 88/57 312/333 |
| 8,196,939 | B2 | 6/2012 | Bustle et al. | |
| 10,750,863 | B2 | 8/2020 | Nugent | |
| 10,905,241 | B1 * | 2/2021 | Stravitz | A47B 91/12 |
| 10,932,569 | B2 * | 3/2021 | Held | A47B 88/956 |
| 2017/0021958 | A1 * | 1/2017 | Shelton | A47B 61/00 |
| 2022/0007834 | A1 * | 1/2022 | Stravitz | A47B 91/12 |

* cited by examiner

DRAWER RETENTION MECHANISMS FOR FURNITURE

CROSS-REFERENCE TO RELATED APPLICATIONS

This application is a continuation-in-part of U.S. patent application Ser. No. 17/483,903 filed Sep. 24, 2021 which is a continuation-in-part of U.S. patent application Ser. No. 17/443,615 filed Jul. 27, 2021 which is a divisional of U.S. patent application Ser. No. 17/194,401 filed Mar. 8, 2021, now U.S. Pat. No. 11,103,067, which is a continuation-in-part of U.S. patent application Ser. No. 17/094,979 filed Nov. 11, 2020, now U.S. Pat. No. 10,939,761, which is a continuation-in-part of U.S. patent application Ser. No. 16/992,397 filed Aug. 13, 2020, now U.S. Pat. No. 10,905,241, which is a continuation of U.S. patent application Ser. No. 16/986,932 filed Aug. 6, 2020, now U.S. Pat. No. 10,813,456, which is a continuation-in-part of U.S. patent application Ser. No. 16/799,909 filed Feb. 25, 2020, now U.S. Pat. No. 10,758,046, and also a continuation-in-part of U.S. patent application Ser. No. 16/799,941 filed Feb. 25, 2020, now U.S. Pat. No. 10,786,080, and U.S. patent application Ser. No. 16/799,909 claims the benefit under 35 U.S.C. § 119 of U.S. provisional patent application Ser. No. 62/944,425 filed Dec. 6, 2019, and U.S. provisional patent application Ser. No. 62/949,664 filed Dec. 18, 2019, all of which are incorporated by reference herein.

This application is also related to, on the grounds that it includes common disclosure as, U.S. patent application Ser. No. 16/935,335 filed Jul. 22, 2020, now U.S. Pat. No. 10,856,659, which is also incorporated by reference herein.

FIELD OF THE INVENTION

The present invention relates generally to drawer retaining systems or drawer retention mechanisms incorporated into a piece of furniture that prevents unintentional and unwanted outward sliding of the drawer, especially during tipping of the piece of furniture. The present invention also relates to a piece of furniture including or incorporating such drawer retaining systems and drawer retention mechanisms.

The present invention also relates to a drawer sliding mechanism for pieces of furniture that requires a certain amount of force to open. This prevents toddlers and infants unable to exert such force from opening the drawer and potentially causing tipping of the furniture when the drawer would be open and susceptible to being pulled downward causing it to tip over.

The present invention also relates to methods for regulating opening of a drawer of a piece of furniture to prevent inadvertent opening of the drawer and also opening of the drawer during tipping of the piece of furniture.

BACKGROUND OF THE INVENTION

Furniture tipping accidents and deaths are on the rise. The majority many of toddler furniture pieces, typically dressers, are anywhere from about 16 inches to about 24 inches deep and often toddlers can grab the top of the dresser, grab the top drawer of the dresser and even climb into the bottom drawer of the dresser before the parent is aware of this. Top drawers of these dressers often have heavy contents in them further making the dresser easier to tip over, which when it occurs, often results in the toddler getting severely hurt, sometimes even rushed to the hospital and even more worrisome, a tragic death.

Often, dressers tip over when an open drawer is pulled downward. The present invention seeks to reduce or eliminate the possibility of toddlers and infants from being able to open drawers of pieces of furniture and thereby reduce the potential for tipping over arising from open drawers.

OBJECTS AND SUMMARY OF THE INVENTION

It is an object of at least one embodiment of the present invention to provide new and improved systems for integrating or incorporating into pieces of furniture to prevent drawers of the furniture from sliding out during tipping over of the piece of furniture.

It is another object of at least one embodiment of the present invention to provide new and improved drawer retention mechanisms integrated or incorporated into pieces of furniture to prevent drawers of the furniture from easily being slidable outward unless a specific movement of the drawer is undertaken.

It is yet another object of at least one embodiment of the present invention to provide methods for regulating opening of a drawer of a piece of furniture to prevent inadvertent opening of the drawer and also opening of the drawer during tipping of the piece of furniture.

A piece of furniture such as a dresser in accordance with one embodiment of the invention includes a frame having a front, a drawer slidable through the front of the frame into the frame and alternatively slidable partly out of the frame, and which drawer has first and second opposed side walls, and a drawer retention mechanism arranged between the first side wall of the drawer and a respective portion of the frame alongside the first side wall. The drawer retention mechanism includes an elongate, horizontal track on one of the first side wall or the respective portion of the frame alongside the first side wall, and which track is defined between an upper part and a lower part. There is a first stop on the upper part including a rear surface and an angled front surface, and a movable, elongate rail and a second stop on the other of the first side wall or the respective portion of the frame alongside the first side wall. The rail and track are positioned relative to one another such that the rail is movable in the track.

The first and second stops are positioned relative to one another to cause contact of the front surface of the second stop and the rear surface of the first stop to prevent sliding of the drawer out of the frame and such that the angled rear surface of the second stop comes into contact with and slides over the angled front surface of the first stop during insertion of the drawer into the frame.

In one embodiment, the first stop is spaced apart a distance from the second stop such that a distance between the rear surface of the first stop and the front surface of the second stop is equal to or larger than a thickness of a front panel of the drawer.

Another embodiment of a piece for furniture in accordance with the invention includes a frame having a front, a drawer slidable through the front of the frame into the frame and alternatively partly out of the frame and which has opposed side walls, and a drawer retention mechanism arranged between each side wall and a respective portion of the frame alongside that side wall. Each drawer retention mechanism includes a movable, elongate rail, an elongate, horizontal track in which the rail is movable, a front well at a frontend region, an optional rear well at a rear end region spaced apart from the front well with the front and rear wells opening to a common direction, and a spring-loaded plunger that projects into the front or rear well when the drawer is in a closed state. The plunger has a compressed state when projecting against the straight portion of the rail.

In one embodiment, the front well and rear well when present are formed on the rail and the plunger projects into the track. In this case, the straight portion of the rail is between the front and rear wells, and the plunger projects into the front well when the drawer is in the closed state. If the front and rear wells open in a downward direction, the plunger projects upward into the front well when the drawer is in the closed state or against the straight portion of the rail. In each drawer retention mechanism, the plunger can project upward into the rear well when the drawer is in a maximum safe open state, and this hinders continued movement of the drawer out of the frame.

Also, in each drawer retention mechanism, the track may be defined between an upper part and a lower part, and the plunger arranged in a front region of the lower part. The plunger may have a hemispherical shaped or otherwise curved plunging portion, and a compression spring having one end against a surface of the portion and an opposite end in a well in the lower part. Also, in each drawer retention mechanism, the front well can have a greater depth than a depth of the rear well. In one embodiment, in each drawer retention mechanism, the rail is attached to the side wall and the track is formed on or as part of the frame.

BRIEF DESCRIPTION OF THE DRAWINGS

The invention, together with further objects and advantages thereof, may best be understood by reference to the following description taken in conjunction with the accompanying drawings, wherein like reference numerals identify like elements, and wherein.

DETAILED DESCRIPTION OF THE INVENTION

Figure 1:
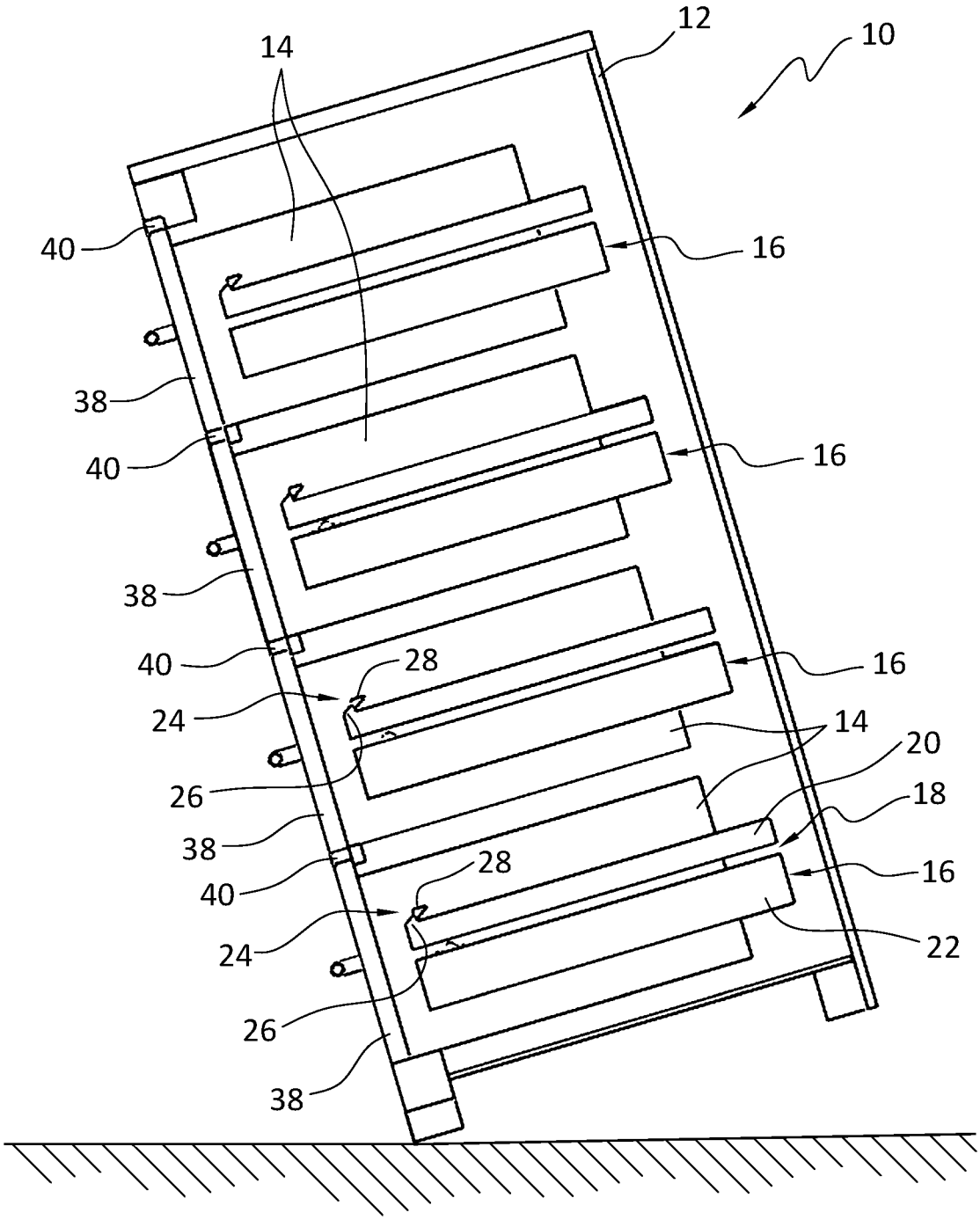
FIG. 1 is a side view of a piece of furniture with the side panel removed showing a drawer retention system in accordance with the invention, and showing that the drawers do not slide out when the furniture is in a tipping state.

In the embodiments disclosed herein, a dresser including a plurality of drawers is often used as an example of a piece of furniture for which the drawer slide-prevention mechanism during tipping of the furniture may be used, and in which the drawer slide-prevention mechanism may be integrated or incorporated. The drawer slide-prevention mechanisms of the invention can be used on other types of furniture in addition to dressers and are not limited to use with only dressers. Also, the dressers may include one or more drawers in any of the sections therein.

Referring first to FIGS. 1-8, a dresser 10 in accordance with the invention includes a frame 12, a one or more drawers 14 slidable into and out of the frame 12 (four drawers 14 in the illustrated embodiment) and drawer slide supports 16 on the side panels of the frame 12. The frame 12 includes sufficient structure to form a stable housing for the drawers 14 and to this end typically includes a rear panel, side panels, a top panel and a bottom panel. The side panel is not shown in the drawings to enable viewing of the invention, but is present. This side panel may be a planar piece of material that covers the structure shown on the side of the dresser 10. The drawer slide support 16 is between the drawer 14 and the side panel so that by not showing the side panel, the drawer slide support 16 is visible. Part of the drawer slide support 16 is attached or otherwise connected to the inner surface of the side panel.

The front of the dresser 10 may be a panel with apertures through which the drawers 14 pass when sliding into and out of the interior of the frame 12. There may also be interior, side panels if there are, for example, two or more columns of drawers.

Each drawer slide support 16 includes a track 18 defined between an upper part 20 on the frame 12 having a substantially planar lower surface and a lower part 22 on the frame 12 having a substantially planar upper surface, which parts 20, 22 may be integral with the frame 12 of the dresser 10 or separate members that are attached thereto, e.g., the interior surface of the side panels alongside the drawers 14. These parts 20, 22 may be made of any suitable material, e.g., wood or metal, and define the generally horizontal track 18 since it is desired that the drawer 14 opens horizontally.

Dresser 10 includes a drawer slide-out prevention system 24 that has a first stop 26 at the front, upper region of the upper part 20, projecting upward relative to an upper surface thereof behind the first stop 26, and a second stop 28 on each drawer 14 positioned relative to the first stop 26 to provide for the functional effect described below. The first stop 26 has a rear face 30 that serves as a stop surface and an angled front surface 32 that forms an upward-facing ramp when viewed toward a rear of the frame 12. The rear face 30 may be contiguous with the upper surface of the upper part 20. The first stop 26 therefore has a triangular shape projecting upward from the upper surface of the upper part 20 on the frame 12 that defines the track 18 below it. The first stop 26 is not required to be attached to the upper part 20 defining the track 18 but this is a preferred construction.

The second stop 28 has a front face 34 that serves as a stop surface and an angled rear surface 36 that forms a downward-facing ramp when viewed toward a front of the frame 12. The second stop 86 therefore has a triangular shape projecting downward from the upper surface of the side panel 14A of the drawer 14. Other shapes are possible provided the front face 34 is capable of serving as a barrier and the angled rear surface 36 is angled suitably rearwardly. The characteristics of the top surface of the triangular-shaped second stop 28 are essentially inconsequential provided it does not interfere with the opening or closing movement of the drawer 14.

The slopes of the angled front surface 32 and angled rear surface 36 should be selected to be the same or similar, and at whatever angles are determined to provide for easy pushing of the second stop 28 over the first stop 26 in order to close the drawer 14, described below.

Drawer slide-out prevention system 24 may be used together with the drawer retention mechanism 52 described below with reference to FIGS. 10-14, i.e., for use with the same drawer, or independent thereof.

The particular shape of the surfaces of the first and second stops 26, 28 can vary from that shown, provided the stops 26, 28 engage with one another to prevent forward movement of the drawer 14 out of the frame 12 unless the drawer 14 is lifted to a position in which the second stop 28 is able to clear the first stop 26 in a vertical direction.

Figure 2:
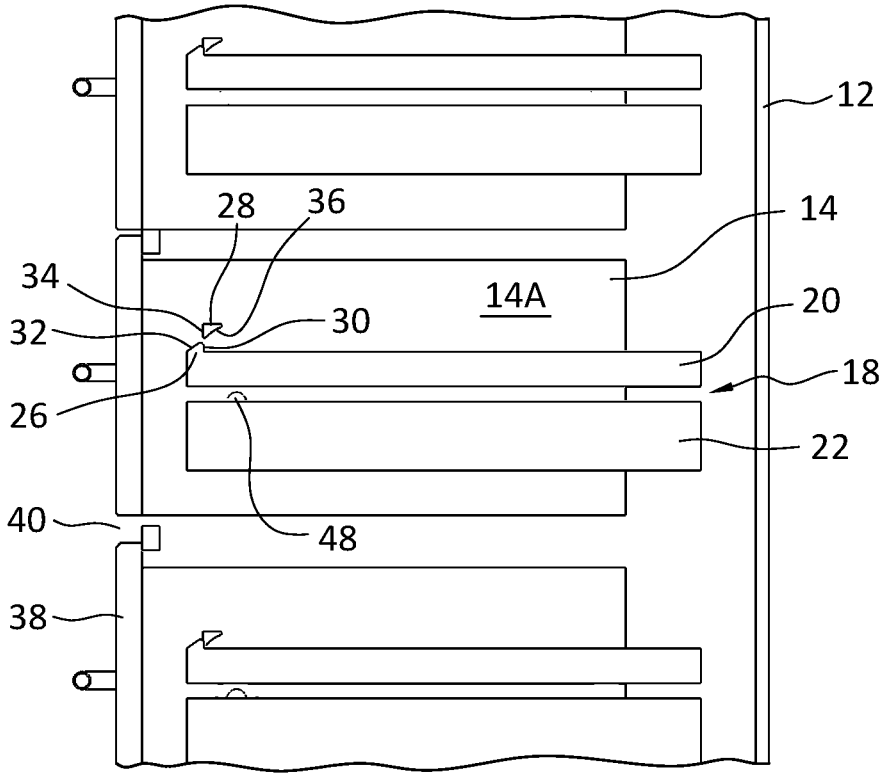
FIG. 2 is a side view of part of the piece of furniture shown in FIG. 1 showing a first stage of sliding out or opening of a drawer from the piece of furniture.

That is, in order to open the drawer 14 from the fully closed state shown in FIG. 1, which may also be considered a locked state, the person must first lift the drawer 14 upward until the second stop 28 is vertically above the first stop 26, see FIG. 2. A toddler or infant is usually unable to do this, and this alone prevents the toddler and infant from sliding the drawer 14 out and then pulling the drawer 14 downward causing the furniture 10 to tip over. The drawer slide-out prevention mechanism therefore provides an anti-tipping feature or characteristic to a piece of furniture.

Figure 3:
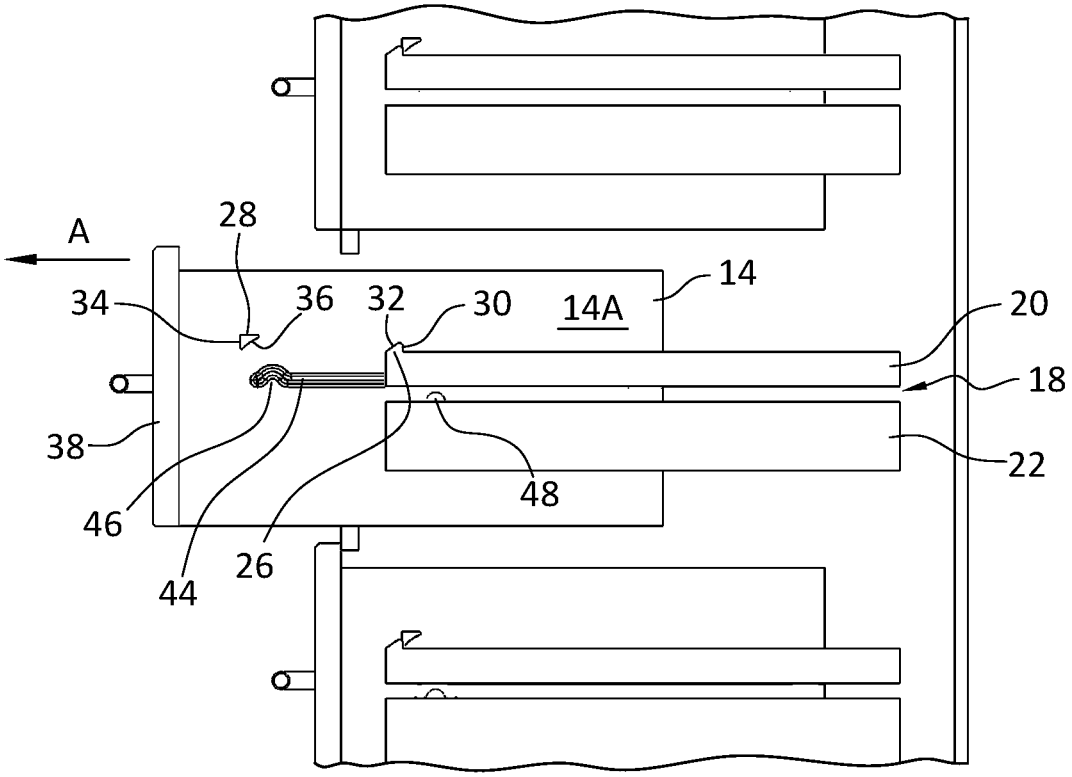
FIG. 3 is a side view of part of the piece of furniture shown in FIG. 1 showing a second stage of sliding out or opening of a drawer from the piece of furniture.

Once the second stop 28 is vertical above the first stop 26, the person then pulls the drawer 14 forward as shown in FIG. 3 (arrow A). A rail 44 is on a side panel 14A of the drawer 14 and slides in the track 18 between the upper and lower parts 20, 22. The rail includes a downward-facing well 46 and a plunger 48 is shown that engages with the well 46. The well 46 and plunger 48 are optional, and described more fully in the embodiment of FIGS. 10-14.

Moreover, when the dresser 10 is tipped forward as shown in FIG. 1, the drawers 14 cannot slide forward in view of the contact of the second stop 28 against the first stop 26. This also provides an advantage of the invention.

Preferably, there is a set of first and second stops 26, 28 on each side of the drawer 14 (only one side is shown but the same configuration is present on the other side of the drawer 14), and possibly on each side of every drawer 14 in a piece of furniture. Nonetheless, the drawer slide-out prevention system 24 may be used selectively on only a portion of the drawers of a piece of furniture.

Although the dresser 10 is susceptible to tipping over when one of the drawers 14 is open, presumably since an adult would open the drawer 14 and not a toddler or infant, the adult would close the drawer 14 after use and thus the dresser 10 would not remain in a position with an open drawer 14 and thus would not be susceptible to being tipped over by a toddler or infant pulling an open drawer downward.

Figure 4:
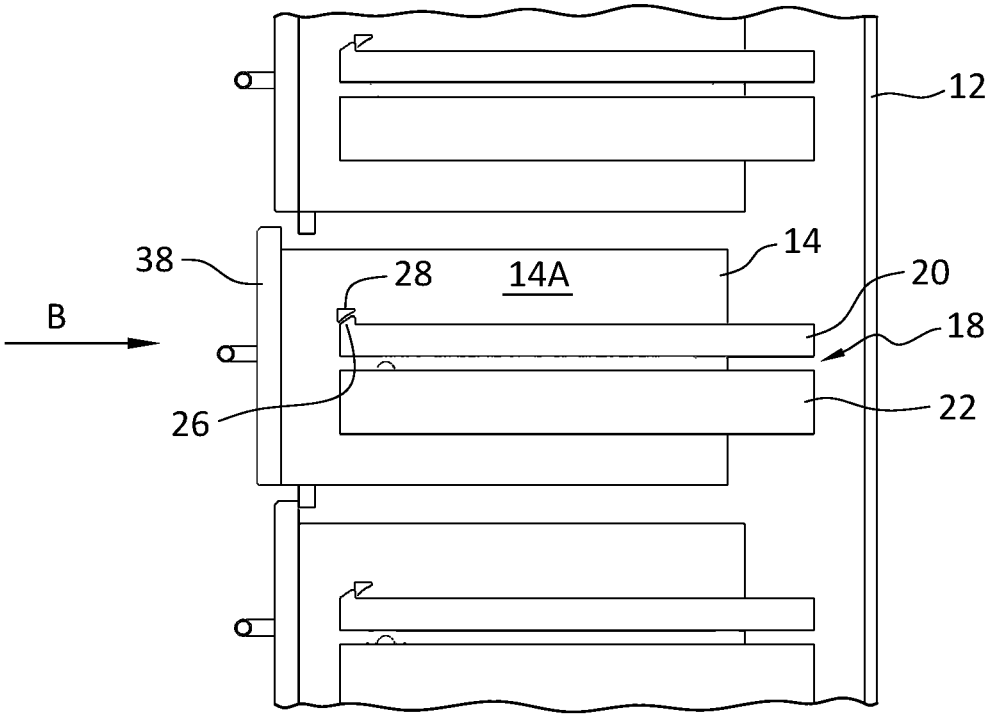
FIG. 4 is a side view of part of the piece of furniture shown in FIG. 1 showing a first stage of insertion of a drawer into the piece of furniture.
Figure 5:
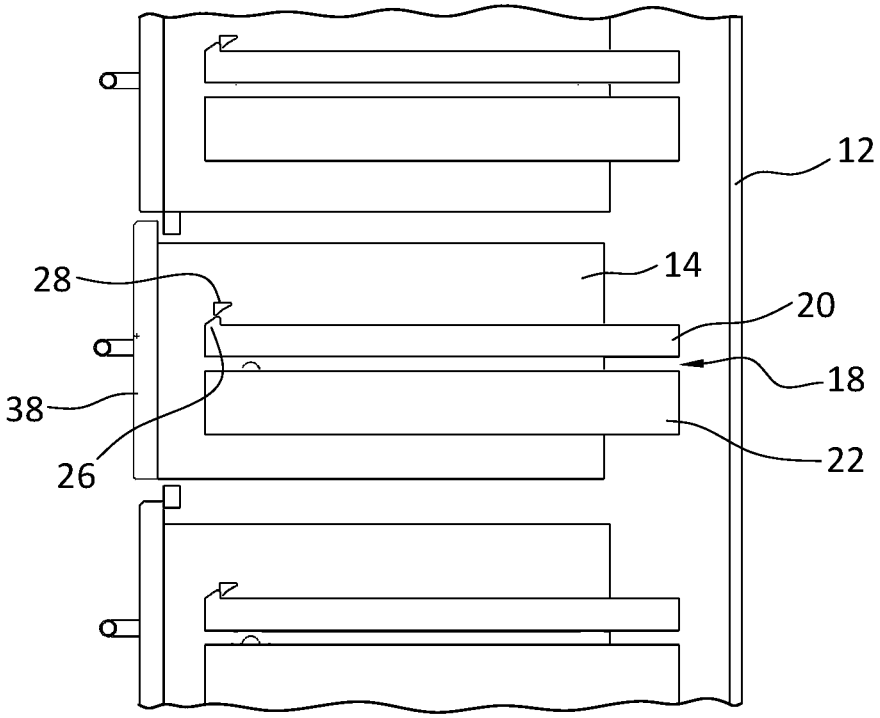
FIG. 5 is a side view of part of the piece of furniture shown in FIG. 1 showing a second stage of insertion of a drawer into the piece of furniture.

To insert the drawer 14, the user pushes the drawer 14 inward until the second stop 28 abuts against the first stop 26 and is in contact therewith as shown in FIG. 4, this movement being in the direction of arrow B. The user then has to continue to push the drawer 14 inward, possibly with slightly more force, to cause the second stop 28 to ride along and over the first stop 26, i.e., the angled rear surface 36 of the second stop 28 engages the angled front surface 32 of the first stop 26 and easily moves over it as shown in FIG. 5 until the second stop 28 has cleared the first stop 26 and is behind the first stop 26. In this position, the second stop 28 is more rearward in the frame 12 than the first stop 26 and the drawer 14 is in its initial, fully closed and locked state (see FIG. 1).

Figure 6:
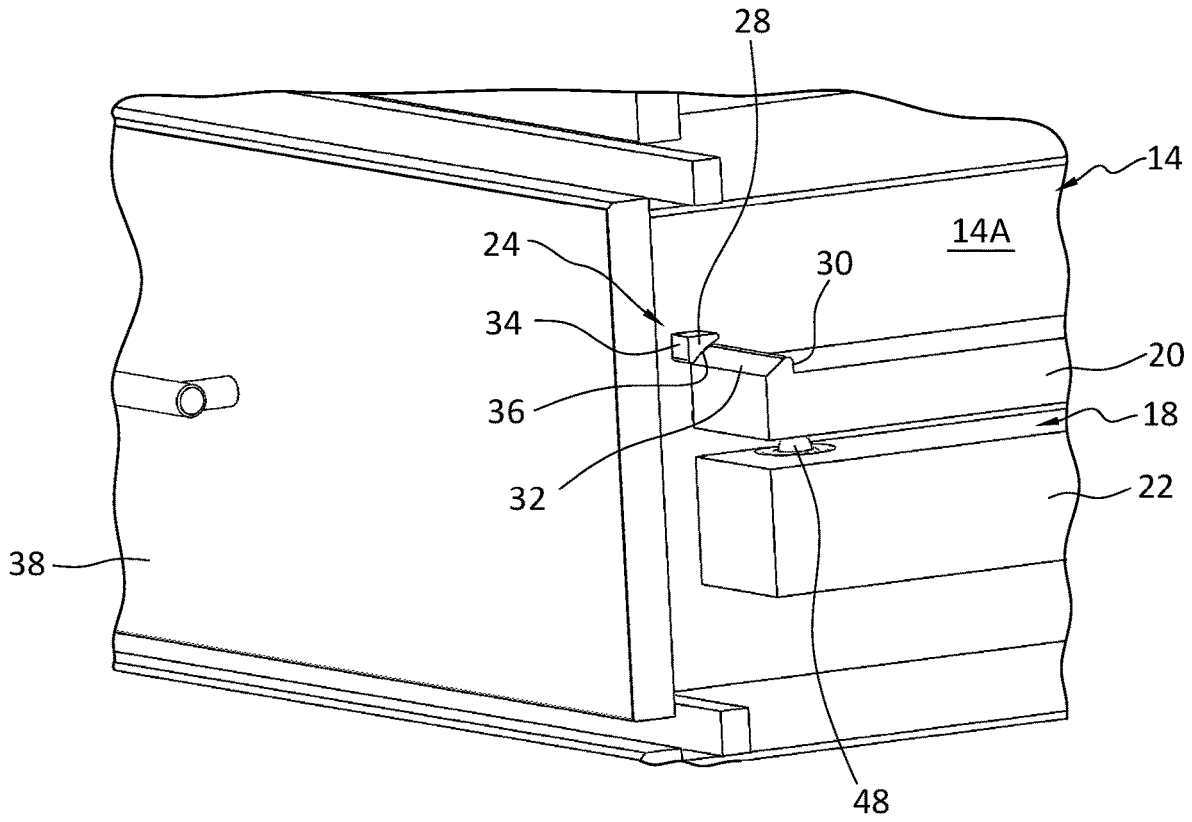
FIG. 6 is a perspective, side view of part of the piece of furniture shown in FIG. 1 showing engagement between the ramp and stop of the drawer retention system in the piece of furniture.

FIG. 6 shows the angled surfaces 32, 36 of the first and second stops 26, 28, respectively. The angled surface 32 may be longer than the angled surface 36 to ensure that the angled surface 32 engages with the angled surface 36 during insertion of the drawer 14 into the frame 12 of the dresser 10.

In the embodiments illustrated in FIGS. 1-8, the stops 26, 28 are positioned on the upper part 20 of the drawer slide support 16 and the side panel 14A of the drawer 14. Alternative locations for the first and second stops 26, 28 are possible and considered to be within the scope and spirit of the invention, provided they cooperate to enable the locking, release and insertion of the drawer 14 as described above. For example, it is possible to reverse the locking member so that it is part of the track 18 or other part of the drawer slide support 16.

The embodiment of the dresser 10 shown in FIGS. 1-6 requires space to lift up each drawer 14, and to this end, the front panel 38 of the drawer 14 are spaced slightly away from the structure above the front panel 38 (see the spaces 40 in FIG. 1). As such, it is possible to position the second stop 28 immediately rearward of the first stop 26 as shown in FIG. 1 so that as soon as the second stop 28 rides over the first stop 26, the drawer 14 is closed.

Figure 7:
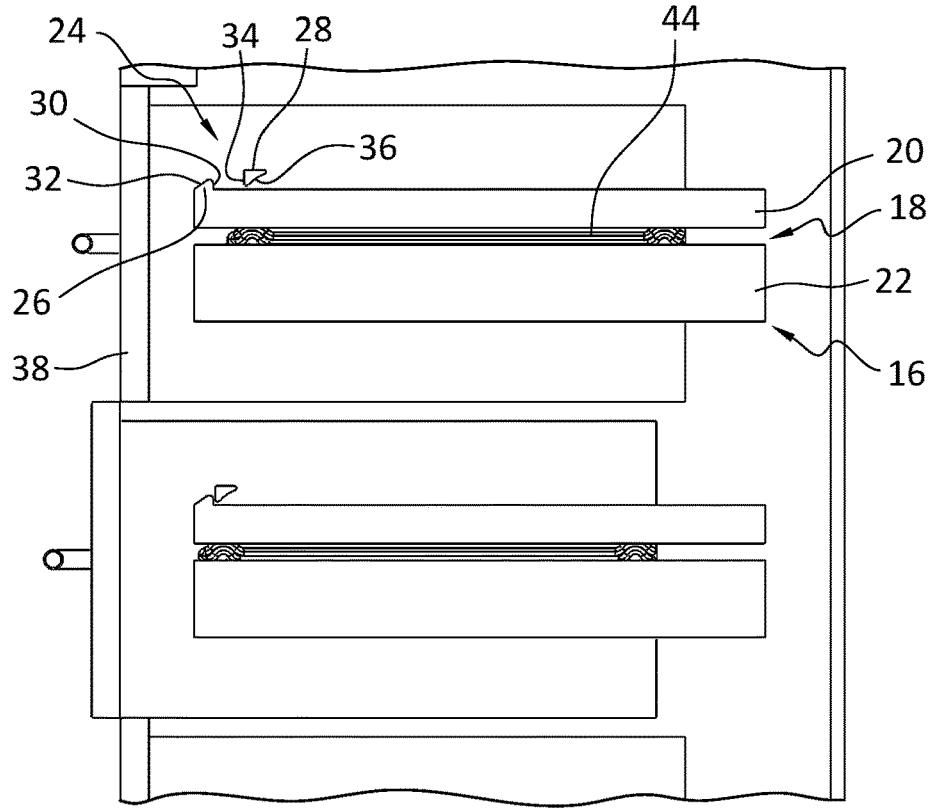
FIG. 7 is a side view of part of a piece of furniture with the side panel removed including a drawer retention system in accordance with another embodiment of the invention showing an initial stage of sliding out or opening of the drawer from the piece of furniture.
Figure 8:
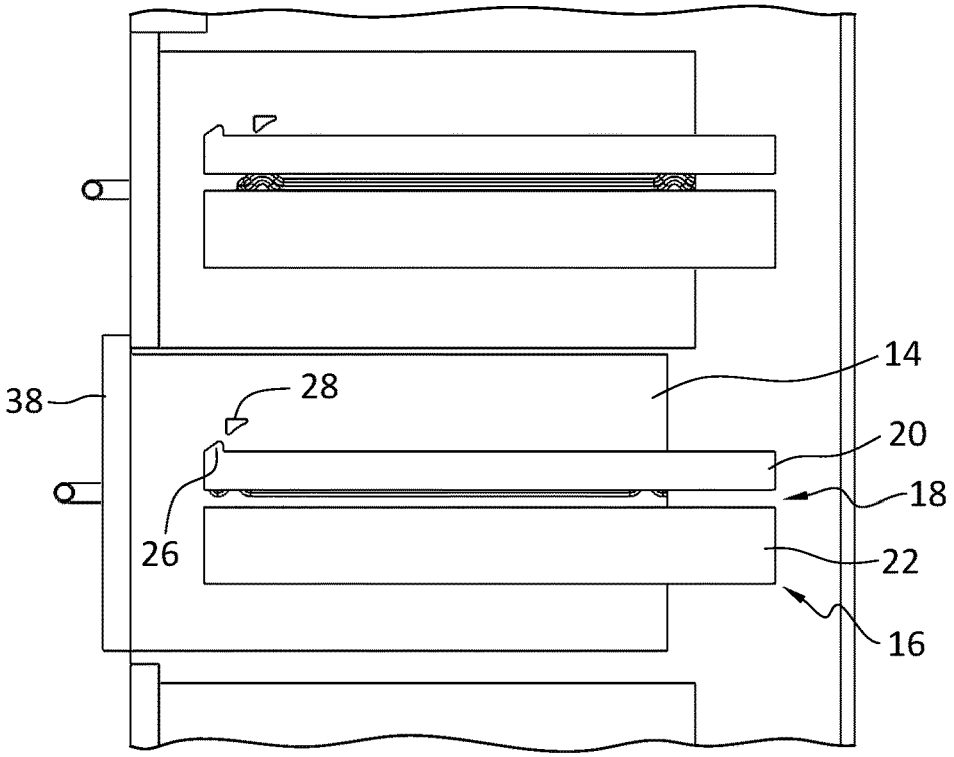
FIG. 8 is a side view of part of the piece of furniture as shown in FIG. 7 showing a later stage of sliding out or opening of the drawer from the piece of furniture.

However, since it is not always possible or desirable to leave spaces 40 between the front panel 38 of the drawers 14 the overlying part of the frame 12 of the dresser 10, in another embodiment of the invention shown in FIGS. 7 and 8, the second stop 28 is positioned a little rearward of the first stop 26 so that there is a space 42 between the rear face 30 of the first stop 26 and the front face 34 of the second stop 28. This space 42 should be at least equal to the thickness of the front panel 38 of the drawer 14 so that it is possible to pull the drawer 14 forward to a position as shown in FIG. 7 in which the front surface 34 of the second stop 28 comes into contact with the rear surface 30 of the first stop 26.

In this position, the front panel 38 of the drawer 14 is more forward than the front panel 38 of the drawer 14 about it and as such allows the drawer 14 to be lifted without interference from the front panel 38 of the drawer 14 above. Obviously there needs to be a correlation between the thickness of the front panel 38 and the space 42 between the rear surface 30 of the first stop 26 and the front surface 34 of the second stop 28, with the latter being equal to or greater than the thickness of the front panel 38. With this configuration, it is possible to provide the front panels 38 of the drawers to be almost flush against one another at their upper and lower edges as can be gleaned from FIG. 7.

FIG. 8 shows the state of the drawers 14 when the user lifts the middle drawer 14 upward, after pulling it out up to the maximum distance allowed, i.e., when the front surface 34 of the second stop 28 comes into contact with the rear surface 30 of the first stop 26. The drawer 14 can then easily be pulled forward with the second stop 28 passing over the first stop 26. Insertion of the drawer 14 into the dresser 10 is as described above. During this insertion however, the drawer 14 will be moved upward as the angled rear surface 36 of the second stop 28 contacts and slides along the angled front surface 32 of the first stop 28. This movement will occur before the front panel 38 of the drawer 14 is underneath the front panel 38 or furniture part above it and thus is possible. This is an important advantage of the invention in that a dedicated lifting force is not required to insert the drawer 14 into the dresser 10 but rather simply by moving the drawer 14 rearward, it will cause contact between the angled surfaces of the stops 26, 28 and lift itself up and over the first stop 26.

Using the drawer slide-out prevention system 24, the invention also includes a method for regulating opening of the drawer 14 of the dresser 10 including a frame 12 having a front through which the drawer 14 slides into the frame and partly out of the frame 12, and a drawer retention mechanism between a side wall of the drawer 14 and a respective portion of the frame 12 alongside the side wall. The drawer retention mechanism includes an elongate, horizontal track 18 on one of the side wall or the respective portion of the frame 12 alongside the side wall, and which track 18 is defined between the upper part 20 and the lower part 22. In the illustrated embodiment of FIGS. 1-8, the track 18 is on the inner surface of the side panel of the frame 12 but can alternatively be placed on the drawer 14.

The drawer opening regulating method involves arranging the first stop 26 on the upper part 20 and which has preferably the flat and planar rear surface 30, vertically oriented and perpendicular to the horizontal upper surface of the upper part 20 rearward of the first stop 26, and the angled front surface 32 which angles forward and downward to a location approximately in line with the upper surface of the upper part 20, and thus faces the front of the dresser 10. The second stop 28 and the rail 44 are arranged on the other of the side wall or the respective portion of the frame 12 alongside the side wall (on the side 14A of the drawer 14 in the illustrated embodiment). The rail 44 and the track 18 are positioned relative to one another such that the rail 44 is movable in the track 18. The second stop 28 preferably has a flat and planar front surface 34, vertically oriented and perpendicular to the horizontal upper and/or lower surfaces of the drawer 14 or its side panel 14A, and the angled rear surface 32 which angles rearward and upward and thus faces the rear of the dresser 10.

The first and second stops 26, 28 are positioned relative to one another to cause contact of the front surface 34 of the second stop 28 and the rear surface 30 of the first stop 26 which prevents sliding of the drawer 14 out of the frame 12 and such that the angled rear surface 36 of the second stop 28 comes into contact with and slides over the angled front surface 32 of the first stop 26 during insertion of the drawer 14 into the frame 12.

As in the embodiment of FIGS. 7 and 8, it is possible to space the first stop 26 a distance apart from the second stop 28 such that a distance between the rear surface 30 of the first stop 26 and the front surface 34 of the second stop 28 is equal to or larger than a thickness of a front panel 38 of the drawer 14. There may also be an additional set of first and second stops 26, 28 on an opposite side of the drawer 14, which may be a preferred embodiment.

Figure 9:
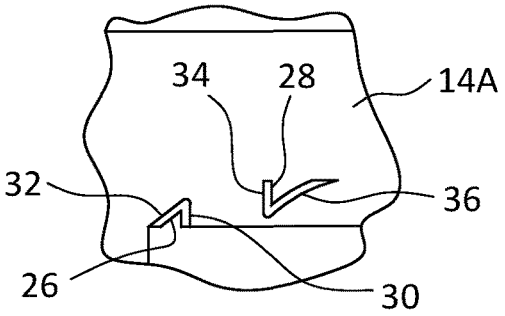
FIG. 9 is a schematic showing another construction of cooperating stops in accordance with the invention.
Figure 10:
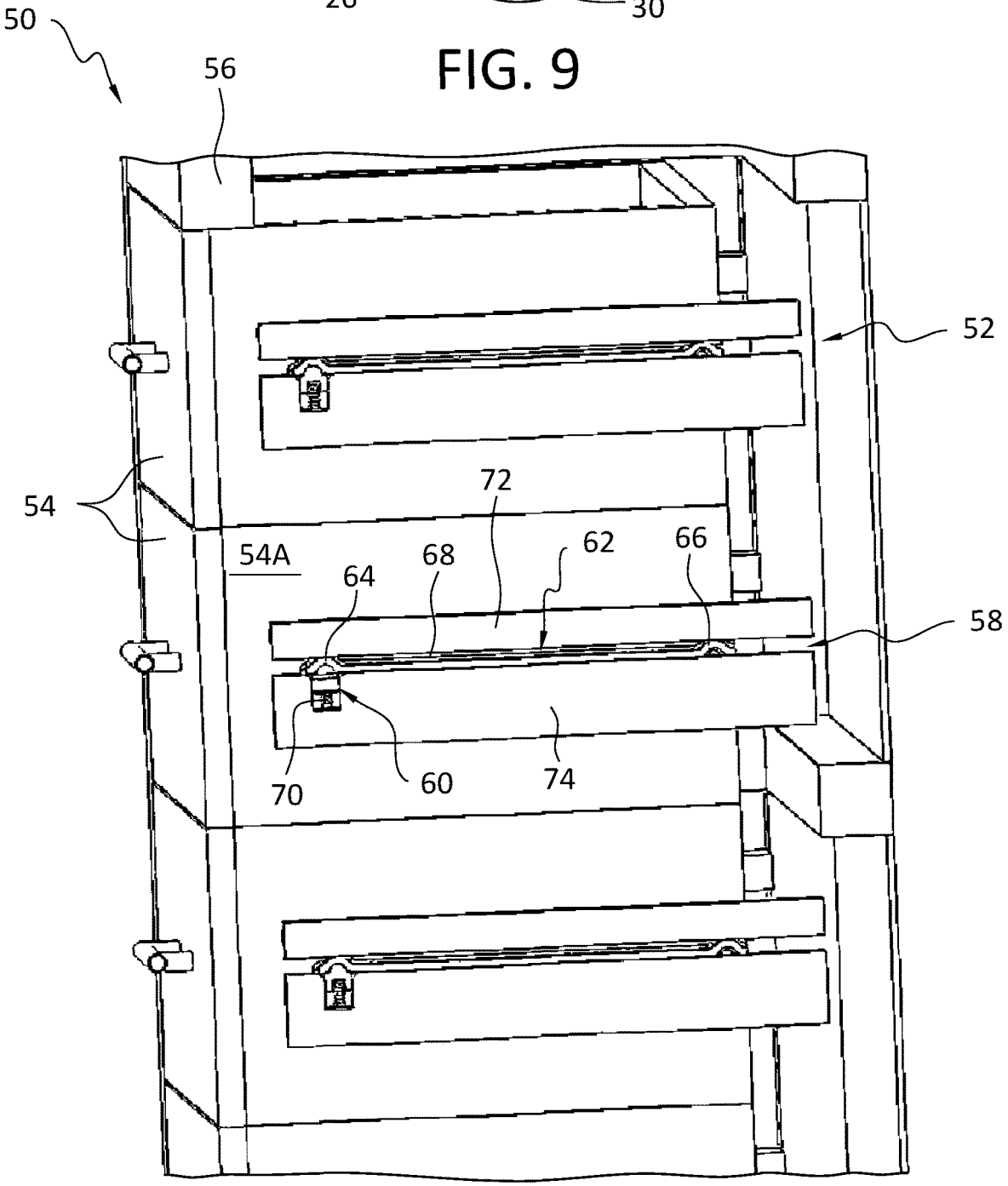
FIG. 10 is a side view of another embodiment of a dresser in accordance with the invention with the side panel of the frame removed.

FIG. 9 is a schematic showing essential components of the first and second stops 26, 28. This drawing conveys that the placement of the first stop 26 on the frame 12 and the placement of the second stop 28 on the side panel 14A of the drawer 14 are not material and can be reversed. That is, it is possible to position the first stop 26 on the side panel 14A of the drawer 14 and the second stop 28 on the frame 12. Also, whichever stop 26 or 28 is positioned on the frame 12 is not required to be attached to the upper part 20 of the structure defining the track 18 and can be separate therefrom. The stops 26, 28 are not required to be triangular with three side surfaces as shown in FIGS. 1-8, but rather can be formed by two elongate pieces of material forming an acute angle therebetween with one piece providing the vertical stop surface 30 or 34 and the other piece providing the angled surface 32 or 36. Even more so, these pieces are not required to be continuous but might even be formed from a series of discontinuous pieces that in combination form a surface of the required size and strength to provide engagement of the surfaces 30 and 34 to prevent opening of the drawer 14 unless there is vertical movement above the stop 26, and also sliding movement during insertion of the drawer 14 arising from contact between angled surfaces 34 and 36.

Figure 11:
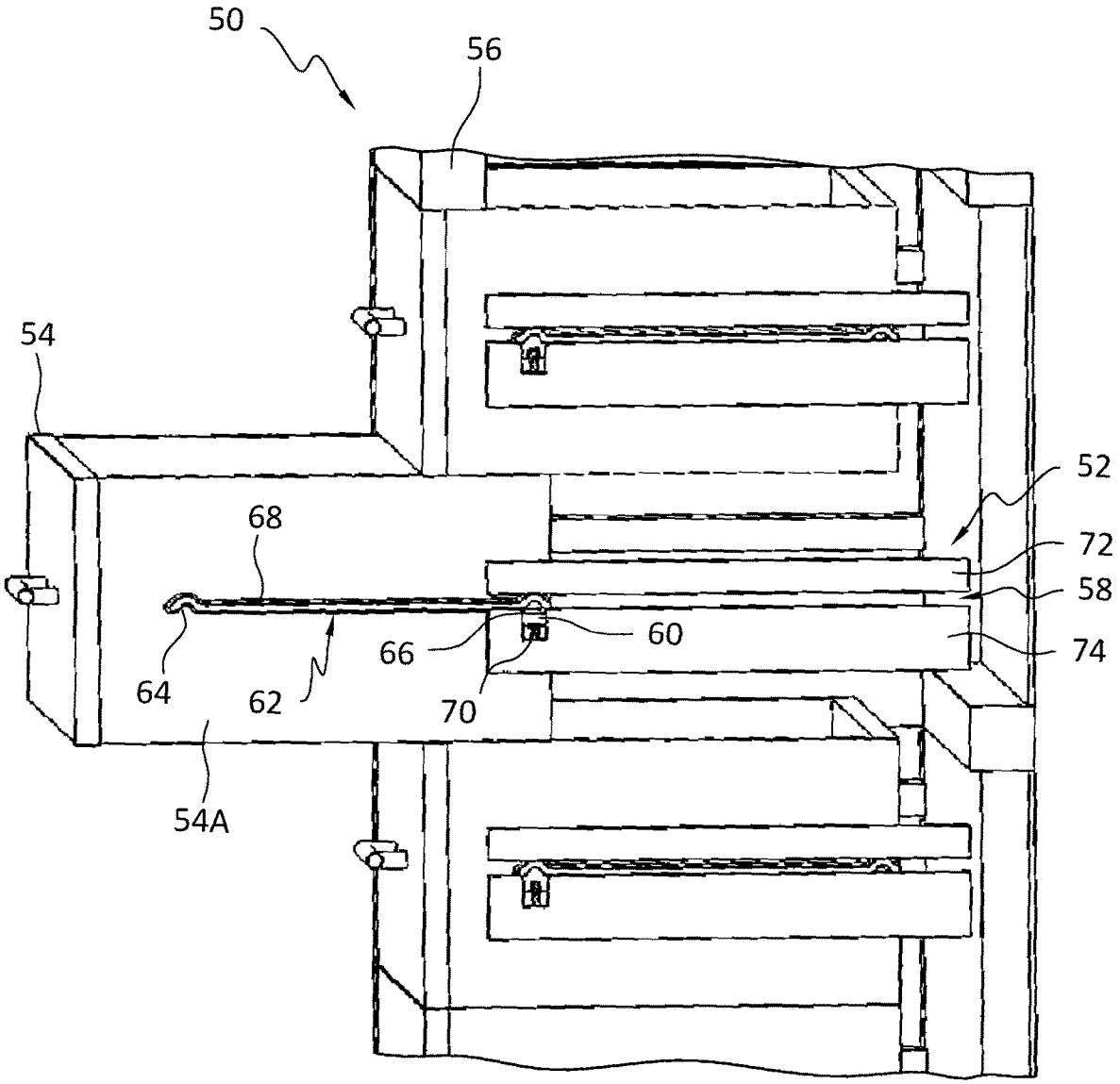
FIG. 11 is a view showing the dresser of FIG. 10 with the drawer in an open state.
Figure 12:
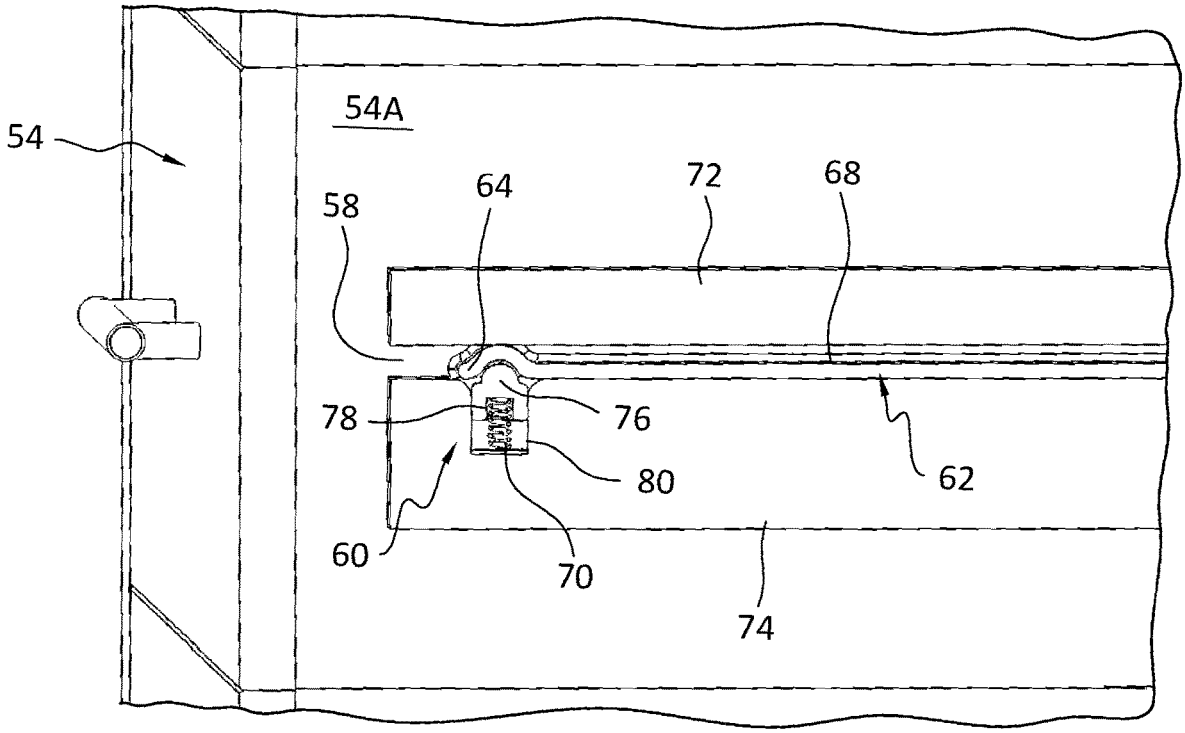
FIG. 12 is an enlarged view of the drawer of the dresser shown in FIG. 10 in a closed state.

Referring now to FIGS. 10-14, a multi-drawer dresser 50 in accordance with the invention includes a drawer retention mechanism 52 that provides secure retention of a respective drawer 54 both when in a closed state (FIG. 10) and in an access state partly out of a frame 56 of the dresser 50 (FIG. 11). In the latter state, the drawer 54 is prevented from moving further forward and possibly causing tipping of the dresser 50 when grasped by a child or toddler. There is a drawer retention mechanism 52 on each side of each drawer 54. The side panel is not shown in the drawings to enable viewing of the invention, but is present. This side panel may be a planar piece of material that covers the structure shown on the side of the dresser 50. The drawer retention mechanism 52 is between the drawer 54 and the side panel so that by not showing the side panel, the drawer retention mechanism 52 is visible. Part of the drawer retention mechanism 52 is attached or otherwise connected to the inner surface of the side panel.

Each drawer retention mechanism 52 includes an elongate track 58 into which a spring-loaded plunger 60 projects and a cooperating elongate rail 62 attached to a side wall 54A of the drawer 54 and that is movable through and in a longitudinal direction of the track 54. The rail 62 includes a pair of concave wells 64, 66, one at each end region of the rail 62, and into which the plunger 60 projects depending on the position of the rail 62 relative to the plunger 60. Between the wells 64, 66, the rail 62 has a straight, elongate portion 68. As shown, the wells 64, 66 open downward while the plunger 60 is configured to spring upward when not pressed downward (the reverse configuration is also a possibility). The plunger 60 thus has a compressed state in which it is maintained below the track 58 by the elongate portion 68 of the rail 62, and a spring 70 therein is compressed, and an extended state in which it projects into one of the wells 64, 66, and the spring 70 therein is expanded. When in the extended state projecting into the front or rear well 64, 66, the spring 70 generates a temporary stop to the movement of the drawer 54.

The rear well 66 is optional and indeed, a drawer retention mechanism 52 may be provided without the rear well 66 and be functional to achieve the object of drawer retention sought by the mechanism. The optional rear well 66 engages with the plunger 60 to establish the maximum pulled-out safe position of the drawer 54, but other means to achieve this pull-out limit may be provided in the invention, including those known to people skilled in the art to which this invention pertains.

Each track 58 may be defined between an upper part 72 of the frame 56 having a planar lower surface and a lower part 74 of the frame 56 having a planar upper surface, which parts 72, 74 may be integral with the frame 56 of the dresser 50 or separate members that are attached thereto. These parts 72, 74 may be made of any suitable material, e.g., wood or metal, and define the generally horizontal track 58 since it is desired that the drawer 54 open horizontally. The plunger 60 is situated in a front region of the lower part 74. Its position is coordinated to the dimensions of the drawer 54 and dresser 50 in general so that the drawer 54 is in its fully closed state when the plunger 60 enters into the front well 64. The parts 72, 74 may even be formed from a single member.

Each of the wells 64, 66 preferably has soft lead-in and lead-out easements, especially at the rear of the front well 64 and the front of the rear well 66 since the upper surface of the plunger 60 will move over these parts when moving into the elongate portion 68 of the rail 62. In one embodiment, an additional plunger is provided at the rear of the track 58 to aid in retention of the drawer 54 and in this case, the easement at the rear of the rear well 66 should also be soft.

Figure 13:
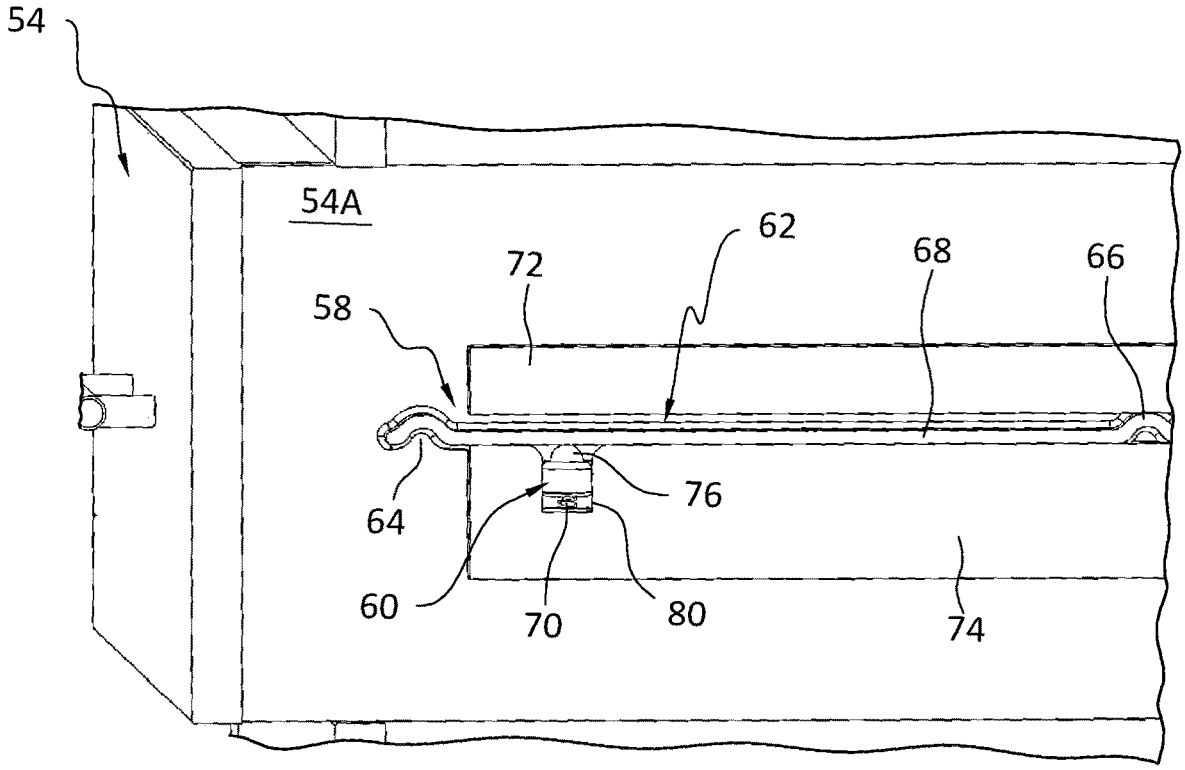
FIG. 13 is an enlarged view showing the drawer of the dresser shown in FIG. 10 in a state during opening or closing movement.
Figure 14:
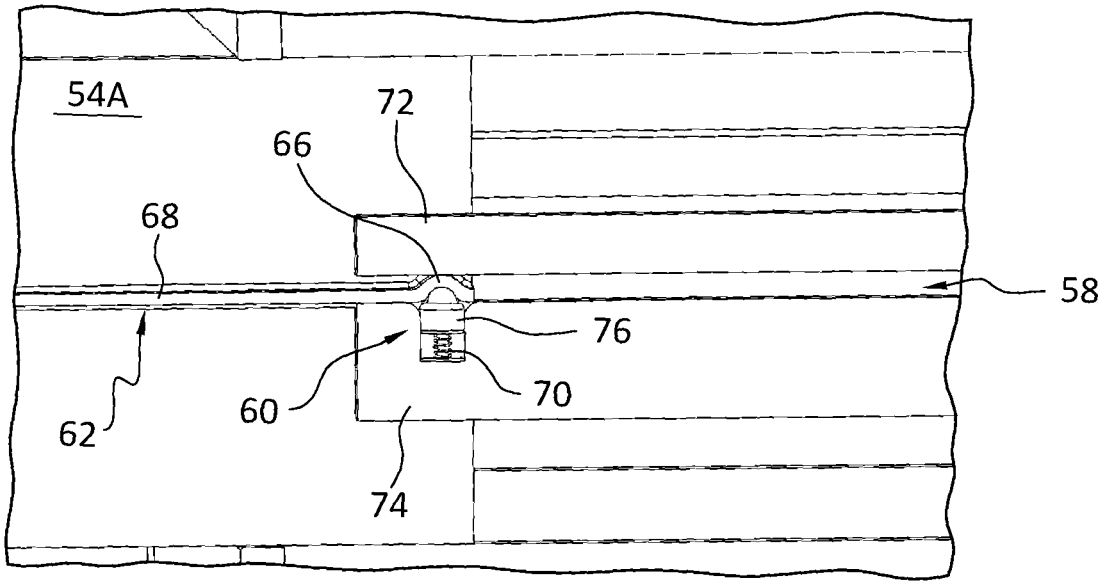
FIG. 14 is a view showing the drawer of the dresser shown in FIG. 10 in a maximally safe open state.

Plunger 60 has a curved plunging portion 76 at its top and the spring 70 enters into a cavity 78 in the plunging portion 76 with the other end of the spring 70 preferably being fixed at the bottom of a well 80 in the lower part 74 (FIG. 14). The plunging portion 76 may be hemispherically shaped. In the compressed state, the upper surface of the plunging portion 76 may be flush with the upper surface of the lower part 74 defining the track 54 (FIG. 13). As such, the elongate portion 68 of the rail 62, which preferably has a flat, planar lower surface, slides easily over the plunging portion 76.

The depth of the front well 64 can be deeper than the depth of the rear well 66 to allow the spring-loaded plunger 60 to form a more forceful safety stop when the drawer 54 is closed. An advantage of this is that in the event the dresser 50 is tipped forward by a toddler, the drawer 54 would resist moving forward to cause injury by hitting the toddler in the face or head. When the drawer 54 is in a partly open state, the plunger 60 will slide along the straight, elongate portion 68 of the rail 62 during continued forward movement of the drawer 54 until a maximum safe open state of the drawer 54 is reached in which the plunger 60 projects into the rear well 66, and thereby the drawer 54 is prevented from moving fully outward and apart from the dresser 50.

In use, when a person wants to open the drawer 54 of the dresser 50, the person must exert a force to overcome the spring force or resistance that is urging the plunger 60 into the front well 64. This force should be greater than the force that a toddler can exert to thereby prevent the toddler from opening the drawer 54, and possibly even a child 3-5 years old. Determination of the magnitude of this force is possible based on the characteristics of the spring force provided by the spring 70 and the easements at the edges of the well 64. Once the plunger 60 is urged downward into the well 80 of the lower part 74 defining the track 58, it remains there by pressure provided by the elongate portion 68 of the rail 62.

In this embodiment, the rail 62 includes the wells 64, 66 and the plunger 60 is incorporated into the lower part 74 defining the track 58. The reverse configuration is also possible, i.e., constructing the rail 62 to include the plunger 60 (which would be at a rear of the rail) and two wells in the upper or lower part 72, 74 defining the track 58 (one at each of forward and rear end regions). In such an embodiment, the plunger would move upon movement of the drawer while the wells would remain stationary (instead of the wells moving and the plunger staying stationary as in the illustrated embodiment).

Furthermore, although in dresser 50, the side rail 62 is attached to the side wall 54A of the drawer 54 and the plunger 60 is mounted in the lower track 74 attached to or part of the frame 56 of the dresser 50, these components can be reversed. That is, it is possible to attach the rail 62 to the frame 56 of the dresser 50 and the upper and lower parts 72, 74 and plunger 60 incorporated into the drawer 54.

While particular embodiments of the invention have been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

The invention claimed is:

1. A dresser, comprising:

a frame having a front:

a drawer slidable through the front of said frame into said frame and alternatively slidable partly out of said frame, said drawer having first and second opposed side walls; and a drawer retention mechanism arranged between said first side wall of said drawer and a respective portion of said frame alongside said first side wall, said drawer retention mechanism comprising:

an elongate, horizontal track on one of said first side wall or said respective portion of said frame alongside said first side wall, said track being defined between an upper part and a lower part;

a first stop on said upper part including a rear surface and an angled front surface; and a movable, elongate rail and a second stop on the other of said first side wall or said respective portion of said frame alongside said first side wall, said rail and said track being positioned relative to one another such that said rail is movable in said track, said second stop including a front surface and an angled rear surface, said first and second stops being positioned relative to one another to cause contact of said front surface of said second stop and said rear surface of said first stop which prevents sliding of said drawer out of said frame and such that said angled rear surface of said second stop comes into contact with and slides over said angled front surface of said first stop during insertion of said drawer into said frame.

2. The piece of furniture of claim 1, wherein said track and said first stop are on said respective portion of said frame, and said rail and said second stop are on an inner surface of said first side wall.

3. The piece of furniture of claim 1, wherein said first stop is spaced apart a distance from said second stop such that a distance between said rear surface of said first stop and said front surface of said second stop is equal to or larger than a thickness of a front panel of said drawer.

4. The piece of furniture of claim 1, wherein said track extends in a longitudinal direction and said rail is movable in the longitudinal direction of said track.

5. The piece of furniture of claim 1, wherein said rear surface of said first stop and said front surface of said second stop are planar, and said second stop has a triangular shape.

6. A method for regulating opening of a drawer of a piece of furniture, the piece of furniture including a frame having a front through which the drawer slides into the frame and partly out of the frame, and a drawer retention mechanism between a side wall of the drawer and a respective portion of the frame alongside the side wall, the drawer retention mechanism including an elongate, horizontal track on one of the side wall or the respective portion of the frame alongside the side wall, the track being defined between an upper part and a lower part, the method comprising:

arranging a first stop on the upper part including a rear surface and an angled front surface; and arranging a second stop and a movable, elongate rail on the other of the first side wall or the respective portion of the frame alongside the side wall, the rail and the track being positioned relative to one another such that the rail is movable in the track, the second stop including a front surface and an angled rear surface, the first and second stops being positioned relative to one another to cause contact of the front surface of the second stop and the rear surface of the first stop which prevents sliding of the drawer out of the frame and such that the angled rear surface of the second stop comes into contact with and slides over the angled front surface of the first stop during insertion of the drawer into the frame.

7. The method of claim 6, wherein the track and the first stop are on the respective portion of the frame, and the rail and the second stop are on an inner surface of the first side wall.

8. The method of claim 6, further comprising spacing the first stop a distance apart from the second stop such that a distance between the rear surface of the first stop and the front surface of the second stop is equal to or larger than a thickness of a front panel of the drawer.

9. The method of claim 6, further comprising an additional set of first and second stops on an opposite side of the drawer.

10. A piece of furniture, comprising:

a frame having a front:

a drawer slidable through the front of said frame into said frame and alternatively slidable partly out of said frame, said drawer having first and second opposed side walls; and a drawer retention mechanism arranged between said first side wall of said drawer and a respective portion of said frame alongside said first side wall, said drawer retention mechanism comprising:

a movable, elongate rail on one of said first side wall or said respective portion of said frame alongside said first side wall, said rail comprising a front well in a front end region;

an elongate, horizontal track on the other of said first side wall or said respective portion of said frame alongside said first side wall, said rail and said track being positioned relative to one another such that said rail is movable in said track; and a plunger on the other of said first side wall or said respective portion of said frame alongside said first side wall and which is urged to project into said front well when said drawer is in a closed state.

11. The piece of furniture of claim 10, wherein said rail further comprises a straight portion rearward of said front well, said plunger having a compressed state when urged against said straight portion of said rail.

12. The piece of furniture of claim 10, wherein said front well opens in a downward direction and said plunger is a spring-loaded plunger urged in an upward direction into said front well when said drawer is in the closed state.

13. The piece of furniture of claim 10, wherein said rail further comprises a rear well at a rear end region spaced apart from said front well by a straight portion, said front and rear wells opening to a common direction.

14. The piece of furniture of claim 13, wherein said plunger is a spring-loaded plunger urged to project upward into said rear well when said drawer is in a maximum safe open state and hinders continued movement of said drawer out of said frame.

15. The piece of furniture of claim 13, wherein said front well has a greater depth than a depth of said rear well.

16. The piece of furniture of claim 13, further comprising lead-in and lead-out easements on said rail alongside said front well.

17. The piece of furniture of claim 10, wherein said track is defined between an upper part and a lower part and said plunger is in a front region of said lower part.

18. The piece of furniture of claim 10, further comprising a lower part and an upper part on the other of said first side wall or said respective portion of said frame alongside said first side wall, said lower part comprising a well and said plunger comprising a curved plunging portion and a spring in said well that urges said curved plunging portion outward from said well.

19. The piece of furniture of claim 10, further comprising an additional drawer retention mechanism arranged between said second side wall of said drawer and a respective portion of said frame alongside said second side wall, said additional drawer retention mechanism comprising:

an additional movable, elongate rail on one of said second side wall or said respective portion of said frame alongside said second side wall, said additional rail comprising a front well in a front end region;

an additional elongate, horizontal track on the other of said second side wall or said respective portion of said frame alongside said second side wall, said additional rail and said additional track being positioned relative to one another such that said additional rail is movable in said additional track; and an additional plunger on the other of said second side wall or said respective portion of said frame alongside said second side wall and which is urged to project into said front well of said additional rail when said drawer is in the closed state.

20. The piece of furniture of claim 10, wherein said track is defined between an upper part and a lower part, further comprising:

a first stop on said upper part including a rear surface and an angled front surface; and a second stop on said first side wall including a front surface and an angled rear surface, said first and second stops being positioned relative to one another to cause contact of said front surface of said second stop and said rear surface of said first stop to prevent sliding of said drawer out of said frame and such that said angled rear surface of said second stop comes into contact with and slides over said angled front surface of said first stop during insertion of said drawer into said frame.

* * * * *